US006009677A

United States Patent [19]

Anderson

[11] Patent Number: 6,009,677

[45] Date of Patent: Jan. 4, 2000

[54] BUILDING PANELS FOR USE IN THE CONSTRUCTION OF BUILDINGS

[75] Inventor: Joseph Anderson, Atherton, Calif.

[73] Assignee: Strathclyde Technologies, Inc., Atherton, Calif.

[21] Appl. No.: 08/902,292

[22] Filed: Jul. 29, 1997

[51] Int. Cl.[7] ..... E04B 1/04; E04B 5/04

[52] U.S. Cl. ..... 52/251; 52/264; 52/270; 52/272; 52/284; 52/285.1; 52/601; 52/602; 52/236.6; 52/583.1

[58] Field of Search ..... 52/125.1, 270, 52/272, 264, 284, 251, 250, 285.1, 583.1, 587.1, 601, 602, 236.6, 262, 266, 267, 630, 261

[56] References Cited

U.S. PATENT DOCUMENTS

| | | | |
|---|---|---|---|
| 2,202,745 | 5/1940 | Muse | 52/602 X |
| 3,228,161 | 1/1966 | McCown | 52/601 X |
| 3,442,056 | 5/1969 | Van Der Lely et al. | 52/601 X |
| 3,545,214 | 12/1970 | Grazel . | |
| 3,555,763 | 1/1971 | Bloxom | 52/601 X |
| 3,604,174 | 9/1971 | Nelson, Jr. | 52/601 |
| 3,747,287 | 7/1973 | Finger | 52/601 X |
| 3,760,540 | 9/1973 | Latoria et al. | 52/601 X |
| 3,772,835 | 11/1973 | Cox et al. | 52/79.11 |
| 3,842,558 | 10/1974 | Scholz et al. | 52/293.3 |
| 3,848,381 | 11/1974 | Bloxom | 52/601 X |
| 3,851,428 | 12/1974 | Shuart . | |
| 3,983,673 | 10/1976 | Bamus | 52/601 X |
| 4,211,045 | 7/1980 | Koizumi et al. | 52/602 X |
| 4,387,544 | 6/1983 | Schilger et al. | 52/601 X |
| 4,388,874 | 6/1983 | Stone | 109/79 |
| 4,442,648 | 4/1984 | Reece | 52/601 X |
| 4,533,362 | 8/1985 | Riley | 52/602 X |
| 4,649,682 | 3/1987 | Barrett, Jr. | 52/601 X |
| 4,676,035 | 6/1987 | Gangarao . | |
| 4,759,160 | 7/1988 | Fischer | 52/251 X |
| 4,858,411 | 8/1989 | Graham . | |
| 4,974,383 | 12/1990 | Deer et al. . | |
| 5,016,411 | 5/1991 | Thorsnes . | |
| 5,065,558 | 11/1991 | Boatsman . | |
| 5,220,761 | 6/1993 | Selby . | |
| 5,248,549 | 9/1993 | Silva et al. | 52/601 X |
| 5,515,659 | 5/1996 | MacDonald et al. | 52/601 X |
| 5,845,441 | 12/1998 | Swartz | 52/250 |

FOREIGN PATENT DOCUMENTS

| | | | |
|---|---|---|---|
| 689905 | 6/1964 | Canada | 52/251 |
| 1176865 | 10/1984 | Canada | 52/602 |
| 2464340 | 3/1981 | France | 52/583.1 |
| 1013589 | 4/1983 | U.S.S.R. | 52/602 |
| 545526 | 6/1972 | United Kingdom | 52/602 |

*Primary Examiner*—Laura A. Callo

*Attorney, Agent, or Firm*—Burns, Doane, Swecker & Mathis, LLP

[57] ABSTRACT

A prefabricated building panel for use in constructing a building structure includes a generally planar concrete panel, a metal member separate from the concrete panel and positioned on an end surface of the concrete panel so that the metal member is exposed for serving as a welding surface, and a plurality of bar anchors welded to the metal member and embedded in the concrete panel. The bar anchor is welded to the metal member to fix the metal member in place relative to the concrete panel. The metal member serves as a connection region for connecting the building panel to another building panel through welding.

14 Claims, 7 Drawing Sheets

BUILDING PANELS FOR USE IN THE CONSTRUCTION OF BUILDINGS

FIELD OF THE INVENTION

The present invention generally pertains to building structures. More particularly, the present invention relates to building panels that are used in the construction of building structures.

BACKGROUND OF THE INVENTION

Structural buildings are fabricated out of a variety of different materials, and the materials used for the construction of any particular building oftentimes depend upon material availability. For residential units, for example, wood is oftentimes used in North America whereas brick and masonry are used in Europe. Likewise, steel is a common material used in North America and parts of Northern Europe for high-rise or industrial buildings whereas the same structures are fabricated of concrete in South America and some European countries. In North America, because of the limited availability of structural timber and the concerns that have been raised from an environmental standpoint, efforts have been made to identify other types of replacement materials. Acceptable alternative materials must be able to compete favorably, both from a cost standpoint as well as a structural integrity standpoint, within the building industry.

In some proposed systems, it has been found that the connection and continuity at right angle cornered junctions is not only difficult and expensive, but often structurally inadequate under different types of loading conditions, particularly seismic loading. This has been a particular concern in the case of concrete sandwiched panels that have been used to create a unit module designed to provide both the necessary structural strength and the necessary insulative properties. Similarly, a number of tilt-up building systems have been found to perform quite poorly under seismic conditions where the connectors have failed.

Thus, the concerns associated with finding alternatives to known proposals for building systems involve safety, energy efficiency, and environmental impact. In addition, with the rising cost of land and building materials, the cost associated with finding an effective and adequate solution is of significant concern.

It has been found that by using assembly line operations, quality and cost economics can be significantly optimized. In addition, the use of assembly line operations allows adequate training in the use of semi-skilled labor. Thus, in considering alternative building materials and components, it would be desirable to utilize to the extent possible assembly line operations.

A further concern associated with finding an adequate alternative to known building materials and components involves transportation costs and limitations. The ability to transport can oftentimes be a determining factor in the size and weight of prefabricated modules used in the construction of building structures. Similarly, the location of the factory relative to the building site and the intervening transportation logistics can also serve as a restriction. Some potentially promising modular concepts have been limited in application because of the foregoing limitations where large dimensions and excessive weight of the factory modules control the extent and scope of implementation.

In light of the foregoing, a need exists for an alternative to current building units that is structural adequate, environmentally acceptable, energy efficient, and cost effective.

It would also be desirable to provide an alternative to current building units that can be manufactured to meet quality requirements.

A need also exists for an alternative to current building units that is not as susceptible to size and weight restrictions from the standpoint of transportation so that the building units can be manufactured at a factory and subsequently transported to the construction site.

SUMMARY OF THE INVENTION

In light of the foregoing, the present invention provides vertical and horizontal prefabricated building panels that address the foregoing needs and provide a variety of advantages over other known building units. The horizontal building panel includes a generally planar concrete slab, a plurality of primary beams made of concrete, with the primary beams being formed with the concrete slab and extending from a lower surface of the slab, and a plurality of secondary beams made of concrete, with the secondary beams also being formed with the concrete slab and extending from the lower surface of the slab. The secondary beams extend transverse relative to the primary beams. A generally U-shaped channel extends along the length of each primary beam at a lower surface of the primary beam. A plurality of bar anchors are welded to each of the channels and each bar anchor is embedded in the concrete forming the primary beam. In addition, a steel plate or angle is provided on the upper surface of the primary beam and extends along the length of the beam. A plurality of bar anchors are welded to the plate or angle to secure the steel plate or angle to the corner or flat surface of the primary beam in a manner that permits connection to other panels in the vertical plane.

The vertical panels are comprised of a concrete slab, but do not have primary and secondary beams extending from the slab. Steel channels are secured to the vertical panels by virtue of a plurality of bar anchors. The bar anchors are welded to the steel channel and are embedded in the concrete forming the slab. The vertical panels can be provided with stub walls that project from the slab to accommodate corner wall or intermediate wall connections.

Another aspect of the present invention involves a building structure that includes a generally planar first concrete panel and a generally planar second concrete panel. The first concrete panel has a first metal member positioned at the end surface of the first concrete panel and a plurality of first bar anchors welded to the first metal member and embedded in the first concrete panel to secure the first metal member in place relative to the first concrete member. The second concrete panel has a second metal member positioned at the end surface of the second concrete panel and a plurality of second bar anchors welded to the second metal member and embedded in the second concrete panel to secure the second metal member in place relative to the second concrete member. The first metal member is welded to the second metal member so that the first and second concrete panels are connected to one another.

BRIEF DESCRIPTION OF THE DRAWING FIGURES

The foregoing and additional features of the present invention will become more apparent from the following detailed description considered with reference to the accompanying drawing figures in which like elements are designated by like reference numerals and wherein.

DETAILED DESCRIPTION OF THE INVENTION

The present invention provides a particular construction for building units or panels that can be used in a variety of different building structures. Generally speaking, the building unit according to the present invention is comprised of a concrete panel in which steel break channel sections or plates are provided at portions of the panel which are to be connected to adjacent panels (e.g., the connection between adjacent floor slabs or between a floor slab and a wall panel). The use of steel break channel sections allows the adjacent panels to be connected together through use of welding. The concrete panels are also provided with deformed bar anchors that are welded to the steel break channel sections (e.g., interior corners of the steel break channel sections) or to the steel plates. The bar anchors extend into the concrete, preferably diagonally, to anchor the break channel sections and plates with respect to the concrete while also providing reinforcement. Alternatively or in addition, headed bar anchors or studs which are welded to the steel break channel sections and/or the steel plates can be used. Reinforcing steel mats are also embedded in the concrete and are integrated with the anchors.

Figure 1:
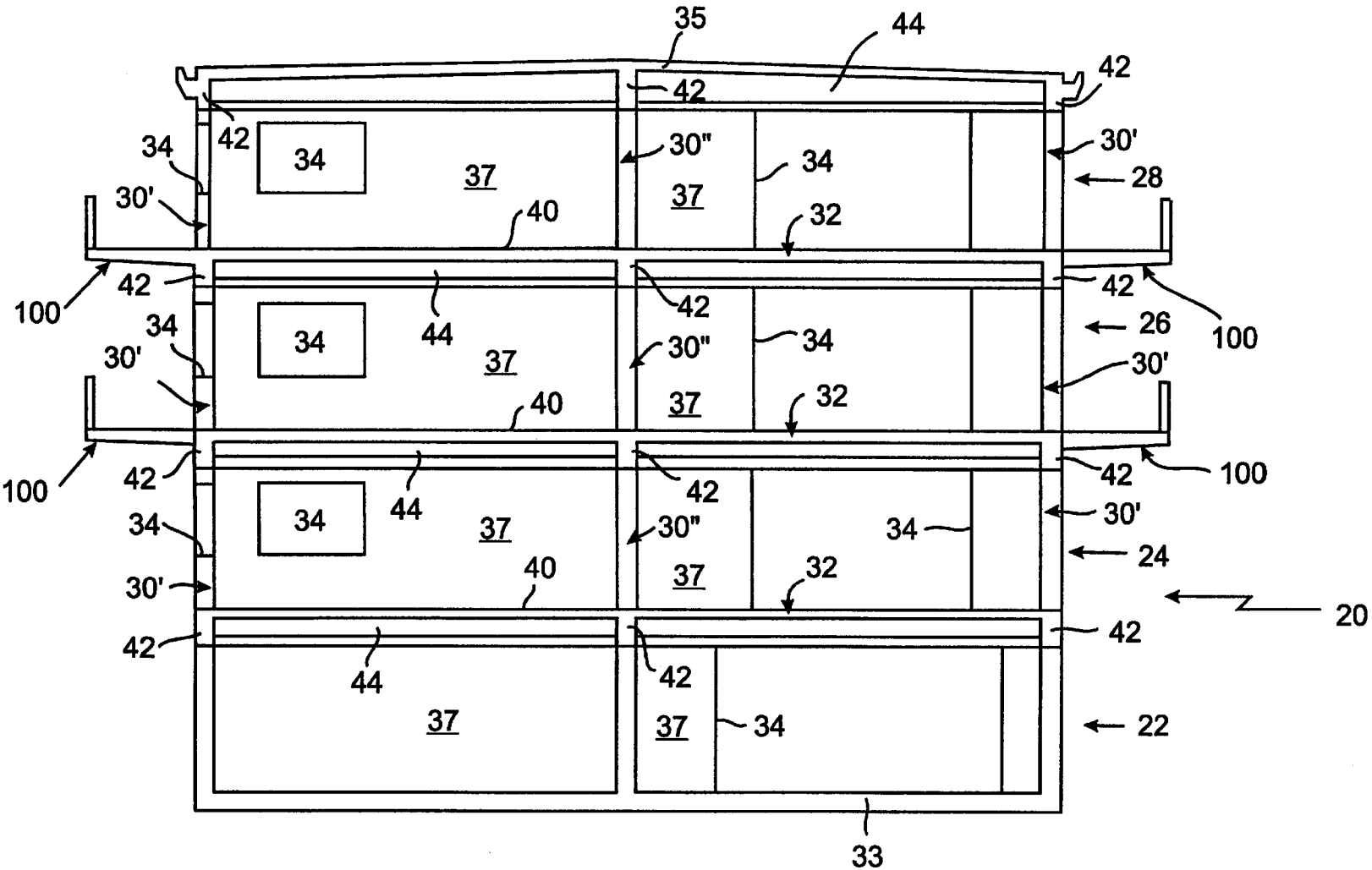
FIG. 1 is a cross-sectional side view of an example of a building structure employing building panels in accordance with the present invention.

For purposes of facilitating an understanding of the present invention, the building units or panels are described and illustrated in the context of a multiple residential dwelling complex, but it is to be understood that the building panels are equally applicable to other types of building structures. As seen with reference to FIGS. 1 and 2, the multiple residential dwelling complex 20 utilizing building panels constructed in accordance with the present invention is a multi level structure that includes a basement 22 which can serve as a parking facility and three stories 24, 26, 28 situated above the basement. The building panels comprising the structure 20 include vertically arranged panels or walls 30', 30", 37, 37' and horizontally arranged panels or floor and roof slabs 32. The vertical panels 30', 30", which extend in the lengthwise direction of the building, can be provided with openings 34 that define windows or doorways, or in the case of the basement level 22, a garage doorway. In the widthwise direction of the building which is illustrated in FIG. 1, the vertical walls include two exterior walls 30' at each level and a longitudinally extending interior bearing wall 30". As shown in FIG. 1, the interior bearing wall 30" is situated in the middle of the horizontal main floor slabs 32 which traverse the entire building width. As described below in more detail, the vertical panels 30', 30" are connected to and integrated with the three main floor slabs 32 as well as the basement slab 33 and the roof slab 35. As shown in FIG. 1, two of the main floor slabs 32 can be provided with cantilevered extensions which serve as balconies. The roof slab 35 is depicted as a cambered roof to permit surface water to be easily drained. The roof slab 35 can also accommodate a parapet wall if a flat roof is to be used and enclosed for purposes of, for example, providing a patio or space for mechanical equipment.

Figure 2:
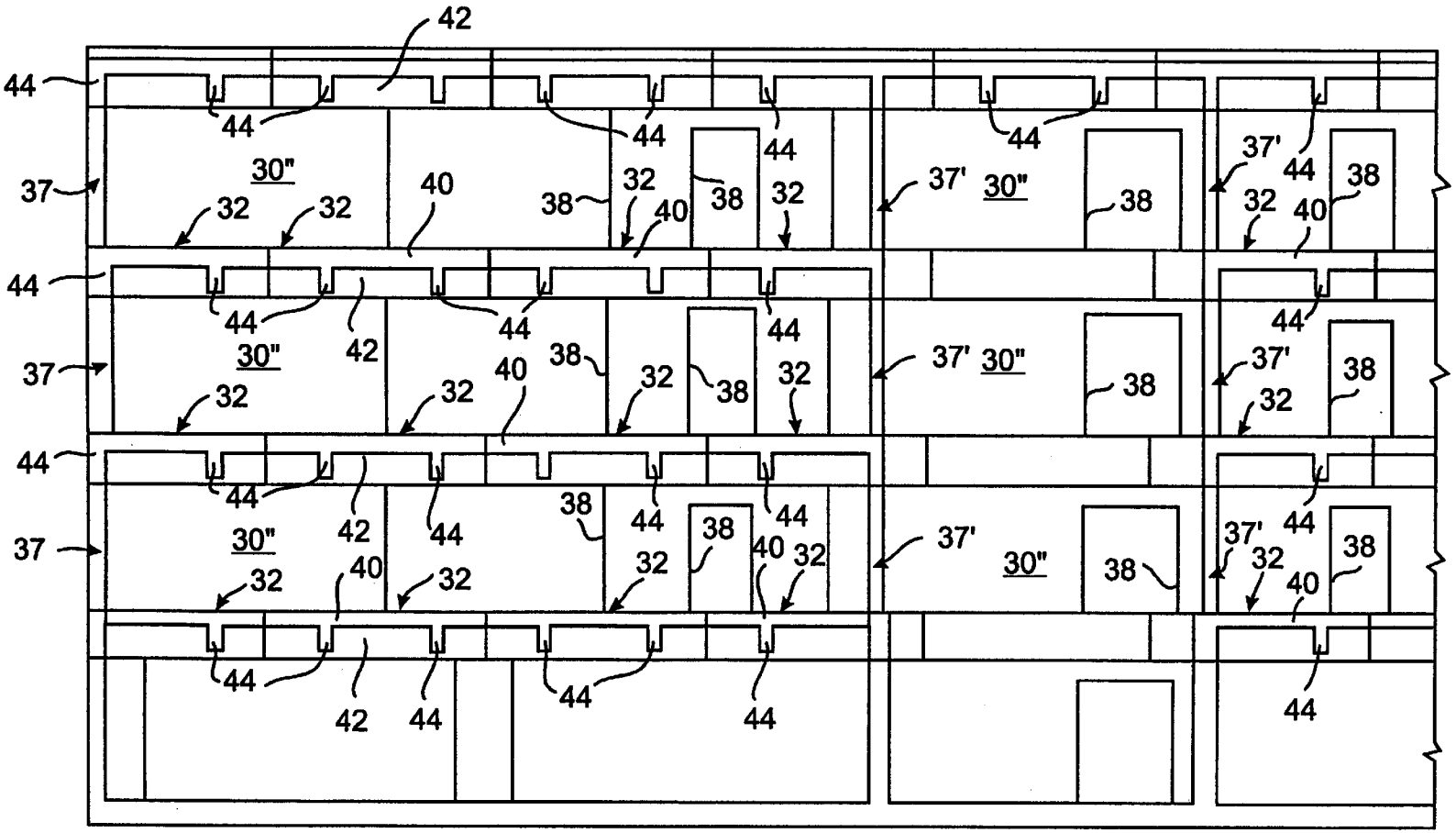
FIG. 2 is a cross-sectional view of a portion of the building structure shown in FIG. 1.

As seen in FIG. 2, which illustrates a portion of the building structure in the lengthwise direction, the vertical panels or side walls 37, 37' extend in the widthwise direction of the building structure. These vertical panels or side walls 37, 37' can be provided with various openings 38 serving as doorways and other access openings.

As seen with reference to FIGS. 1 and 2, each of the horizontally arranged building panels 32 is comprised of a flat planar slab 40, three spaced apart primary beams 42, and a pair of spaced apart secondary beams 44. The primary beams 42 are oriented perpendicular to the slab 40 and extend downwardly from the lower surface of the slab 40. The primary beams 42 extend in the lengthwise direction of the building structure. The secondary beams 44 are also oriented perpendicular to the slab 40 and extend downwardly from the lower surface of the slab 40. The secondary beams 44 extend in the widthwise direction of the building structure and are oriented perpendicular to the primary beams 42.

As seen in FIG. 1, the primary beams 42 located in the middle of the slab 40 are supported on and connected to the central interior bearing wall 30" while the primary beams 42 extending adjacent the edges of the panels 32 are supported on and connected to the exterior vertical wall panels 30'. The connection between the primary beams 42 and the vertical wall panels 30', 30" will be described in more detail below. As seen in FIG. 2, adjacent horizontal panels 32 are connected to one another. The manner of connection between adjacent horizontal panels 32 will also be described below in more detail. As can be seen with reference to FIG. 2, at each level, the secondary beam 44 that is located at the outer edge of the outermost horizontal panel 32 has a slightly greater depth (i.e., extends away from the slab 40 a slightly greater distance)than the other secondary beams 44 to effect the necessary connection with the vertical wall panel 37, 37'. The connection between the secondary beams 44 and the vertical wall panel 37, 37' will become apparent from the description below.

Figure 9:
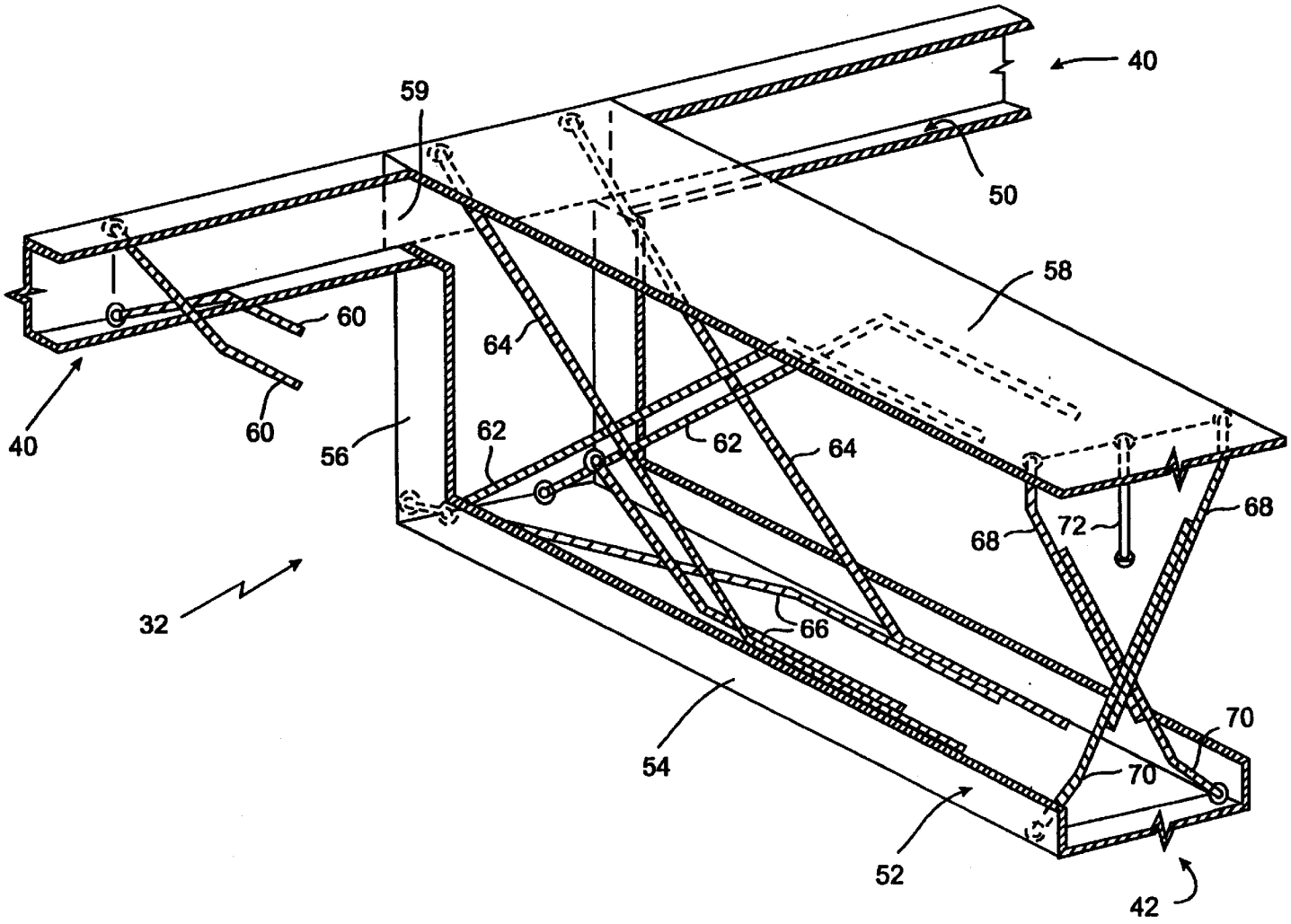
FIG. 9 is a perspective view of a portion of a horizontal building panel constructed in accordance with the present invention.

Each of the horizontal and vertical panels 30, 32 is fabricated of a combination of concrete, break steel sections, steel plates or angles, deformed bar anchors, possibly studs, and reinforcing steel mats. The horizontal and vertical panels typically possess different configurations depending upon the particular location in the building structure. FIG. 9 illustrates a portion of a building panel and particularly the details relating to the primary beam connection. As noted above, both the horizontal and vertical building panels are concrete elements provided with break steel sections, steel plates or angles, deformed bar anchors including possibly studs, and reinforcing steel mats.

FIG. 9 illustrates a horizontal panel in accordance with the present invention except that an illustration of the concrete portion of the panel has been omitted for purposes of clarity and facilitating and understanding of the construction of the horizontal panels.

As seen with reference to FIG. 9, the horizontal panel includes a generally U-shaped steel slab break channel 50 that extends along one edge face of the concrete floor slab. In addition, a U-shaped steel beam break channel 52 extends along the lower concrete portion of the primary beam. The beam break channel 52 includes a horizontal leg 54 that is designed to extend along the lower portion of the primary beam and a vertically extending portion 56 that is designed to extend along the vertical end face of the primary beam. In addition, a flat steel plate 58 is designed to extend along the top surface of the concrete portion of the primary beam. The flat steel plate 58 also includes a vertically downwardly extending leg 59.

FIG. 9 also illustrates the way in which the U-shaped steel beam break channel 52, the flat steel plate 58, and the U-shaped steel slab break channel 50 are connected to one another. In particular, the free end of the vertically downwardly extending leg 59 of the flat steel plate 58 is welded to the upper end of the web portion of the vertically extending portion 56 of the beam break channel 52. Also, the ends of the U-shaped steel slab break channel 50 positioned on either side of the beam break channel 52 are welded to the flat plate 58 and the beam break channel 52. In particular, the upper flange of the slab break channel 50 is welded to the flat plate 58, the web of the slab break channel 50 is welded to the downwardly extending leg 59 of the flat plate 58 and the lower flange of the slab break channel 50 is welded to the flange of the vertically extending portion 56 of the beam break channel 52. The flat plate 58 is typically selected to be slightly wider than the distance between the flanges of the vertically extending portion 56 of the beam break channel 52. Thus, the upper flange and web of the slab break channel 50 are preferably notched to accommodate this difference and permit the welded connection to be made.

Extending outwardly from each interior corner of the slab break channel 50 is a deformed bar anchor 60. The deformed bar anchors 60 are preferably welded to the respective inner corners of the slab break channel 50 and extend diagonally into the concrete, preferably at or about a 45° angle. The end portion of each of the deformed bar anchors 60 is bent as shown in FIG. 9. Thus, when viewed from one end of the break channel 50, the deformed bar anchors 60 cross one another. Pairs of deformed bar anchors like the deformed bar anchors 60 shown in FIG.9 are preferably spaced at regular intervals along the length of the slab break channel 50 to anchor the channel relative to the concrete slab.

A pair of deformed bar anchors 62 extends from the lower interior corner of the beam break channel where the horizontal leg 54 meets the vertical leg 56. The deformed bar anchors 62 extend diagonally upward, pass through the concrete and have end portions that are bent at approximately 45° in the manner shown in FIG. 9 so as to extend generally parallel to and just below the plate 58. Although not specifically shown in FIG. 9, the end portions of the deformed bar anchors 62 are integrated with standard reinforcing steel, e.g., in the form of steel reinforcing mats, that is embedded in the concrete.

Additionally, a pair of deformed bar anchors 64 extends from the interior corner where the upper plate 58 meets the vertical leg 56 of the beam break channel 52. The deformed bar anchors 64, like the other deformed bar anchors, are welded in place at respective interior corners and extend diagonally downwardly through the concrete, preferably at an angle at or about 45°. The end portions of the deformed bar anchors 64 are bent as shown in FIG. 9 so that they extend generally parallel to and just above the inwardly facing surface of the web portion of the horizontal leg 54 of the beam break channel 52. Although not specifically shown in FIG. 9, the end portions of the deformed bar anchors 64 are integrated with standard reinforcing steel, e.g., in the form of steel reinforcing mats, that is embedded in the concrete.

A further pair of deformed bar anchors 66 are welded to interior corners of the beam break channel 52 where the flanges of the vertical leg 56 meet the web of the vertical leg 56. Each of the deformed bar anchors 66 extends in the direction of the length of the horizontal leg 54 of the beam break channel 52. The deformed bar anchors 66 are welded in place at the respective corners and extend diagonally through the concrete. The bar anchors 66 preferably extend from the interior corners at an angle of 45° and then are bent to extend generally parallel to the surfaces of the floor slab. Again, although not specifically shown in FIG. 9, the end portions of the deformed bar anchors 66 are integrated with standard reinforcing steel, e.g., in the form of steel reinforcing mats, that is embedded in the concrete.

Two other deformed bar anchors 68 are welded to the inwardly facing surface of the upper plate 58 and extend downwardly through the concrete towards the horizontal leg 54 of the beam break channel 52. The deformed bar anchors are welded to the inwardly facing surface of the upper plate 58 so that they are perpendicular to and extend from the lower surface of the upper plate and are then deformed at a point along their length so that they extend diagonally through the concrete, preferably at or about a 30° angle, to cross one another.

Another pair of deformed bar anchors 70 is welded to respective interior corners of the horizontal leg 54 of the beam break channel 52 and extend upwardly through the concrete towards the upper plate 58. The deformed bar anchors 70 are welded in place and extend from the interior corners of the break channel section 52 initially at about 45°, but then are deformed at a point along their length to extend diagonally at about 30°, so that they cross one another. Each one of the deformed bar anchors 70 is aligned with (i.e., parallel to) and positioned adjacent to one of the deformed bar anchors 68 as seen in FIG. 9. The particular angular inclination of the bars 68, 70 can be varied with the purpose being to position the bars 68, 70 so that they lie adjacent one another as shown in FIG. 9.

A shear stud 72 is also welded to the inwardly facing surface of the upper plate 58 and extends downwardly into the concrete towards the horizontal leg 54 of the beam break channel 52. Although not specifically shown in FIG. 9, it is to be understood that the end of the horizontal panel 32 opposite the end that is shown in FIG. 9 is provided with an arrangement of deformed bar anchors similar to the deformed bar anchors 62, 64, 66 shown in FIG. 9. Also, the arrangement of the deformed bar anchors 68, 70, 72 are repeated at a uniform spacing along the full length of the primary beam.

Figure 3:
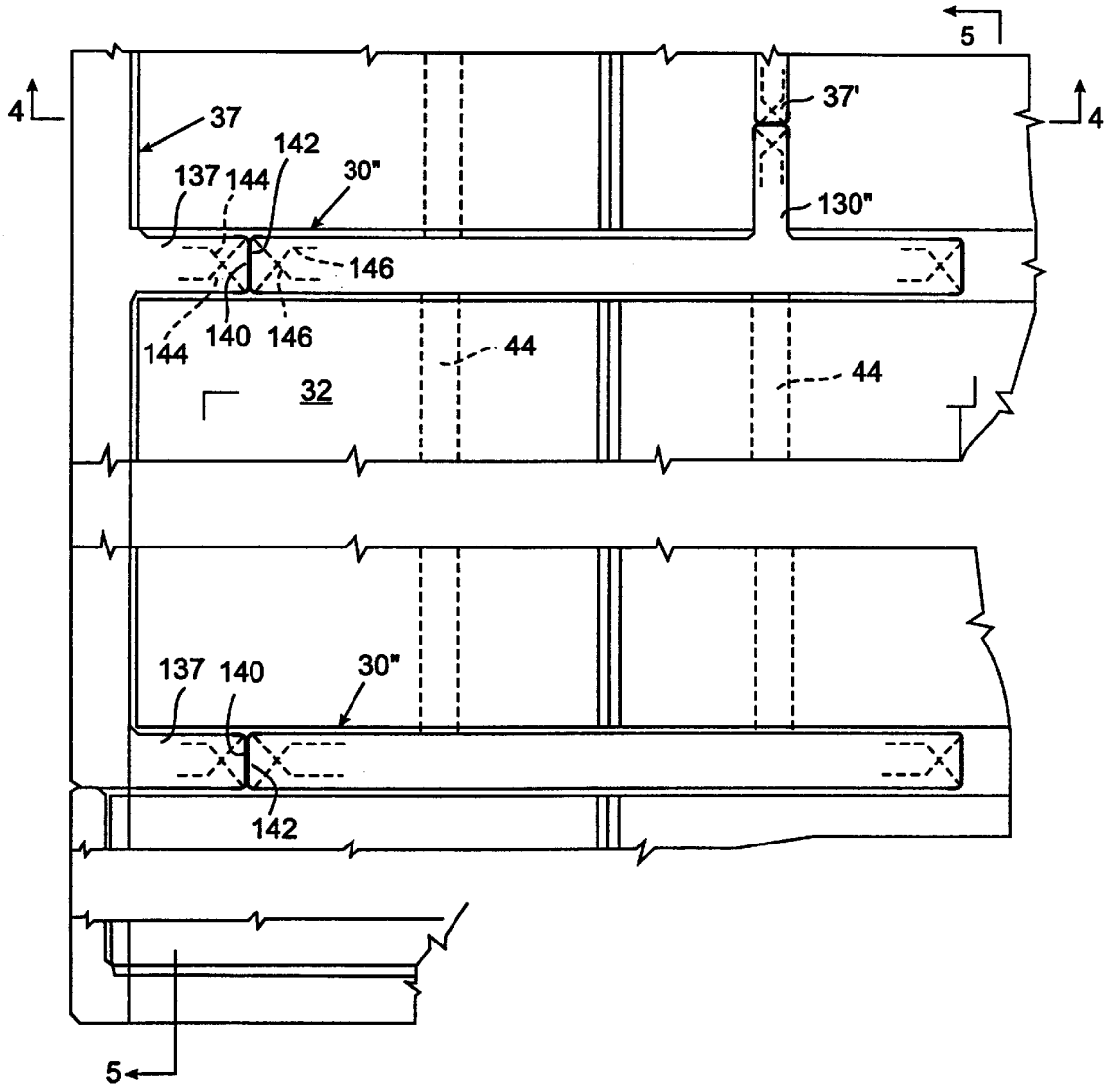
FIG. 3 is a plan view of a corner portion of an upper floor in the building structure shown in FIGS. 1 and 2.

Unlike the horizontal panels, the vertical wall panels are not a beam and slab configuration. Rather, the vertical wall panels 37, 37', 30', 30" are generally comprised of a concrete panel of uniform thickness. However, the vertical wall panels are provided with vertically extending stub walls that are added for effecting vertical wall connections between adjacent wall panels. The stub walls extend outwardly from the wall panels as seen in FIG. 3 which shows a pair of vertical stub walls 137 extending perpendicularly from the vertical wall panel 37 and a vertical stub wall 130" extending perpendicularly from the vertical wall panel 30". The stub walls 137 defines part of a connection for the adjacent wall panels 30" while the stub wall 130" defines part of a connection for the adjacent wall panel 37'. It is to be understood that another stub wall is provided on the end of the wall panel 37 opposite the end shown at the bottom of FIG. 3 to provide connection with the other wall panel 30'. Also, it is to be understood that the wall panel 30" is provided with a plurality of spaced apart stub walls 130" along its length to provide connections with all of the wall panels 37'. The stub walls extend out from the wall panels 30" to a substantially equivalent extent.

To effect the connection between the adjacent wall panels, the vertically facing end surface of each of the stub walls 137, 130" is provided with a metal or steel member in the form of a U-shaped break channel section. Similarly, the facing end surface of the adjacent wall panel is provided with a similar metal or steel member in the form of a U-shaped break channel section. Thus, as seen in FIG. 3, the end face of each of the stub walls 137 is provided with a steel break channel section 140 while the end face of the adjacent wall panel 30" is provided with a steel break channel section 142. The break channel sections 140, 142 extend vertically, preferably along the entire vertically facing end face of the respective wall panels. The two break channel sections 140, 142 are welded to one another to provide the necessary interconnection between the adjacent wall panels.

The break channel sections 140 are anchored with respect to the respective concrete stub wall 137 by deformed bar anchors 144. The deformed bar anchors 144 are welded to the interior corners of the break channel section 140 and are embedded in the concrete forming the stub wall 137. As in the case of the various bar anchors shown in FIG. 9, the bar anchors 144 extend outwardly from the corners of the channel section 140 and are then bent at an angle of about 45°.

Similarly, the break channel sections 142 are anchored with respect to the respective concrete wall panel 30" by deformed bar anchors 146. The deformed bar anchors 146 are welded to the interior corners of the break channel section 142 and are embedded in the concrete forming the wall panel 30". As in the case of the various bar anchors shown in FIG. 9, the bar anchors 146 extend outwardly from the corners of the channel section 142 and are then bent at an angle of about 45°.

FIG. 3 also shows the floor slab or panel 32 underlying the illustrated wall panels 37, 30', 30" as well as the secondary beams 44 forming a part of that underlying floor slab 32. As can be seen from FIG. 3, the wall panel 37' is aligned with one of the secondary beams 44. Indeed, all of the wall panels 37' in the building structure are aligned with secondary beams in one of the floor slabs (or panel) 32. The alignment occurs both with respect to the secondary beams of underlying floor slabs and the secondary beams of overlying floor slabs. The wall panels 37' are connected to the secondary beams of the overlying floor slabs with a connection similar to the connections described above, utilizing the deformed bar anchored break channel sections on facing end surfaces of adjacent panels and welding such break channel sections together.

The use of stub walls 137 is advantageous in that in the building structure, the maximum moment typically occurs at the corner of the structure. By utilizing the stub walls 137 to effect the connection with the adjacent wall panels, the location of the maximum moment is moved away from the connection region between adjoining panels. Although not specifically shown in FIG. 3, all of the end wall panels used in the building structure include standard reinforcing steel (e.g., steel reinforcing mats). The stub walls the connection regions away from the standard reinforcing steel, thus avoiding complexity with respect to the positioning of the anchor bars 144, 146.

Figure 4:
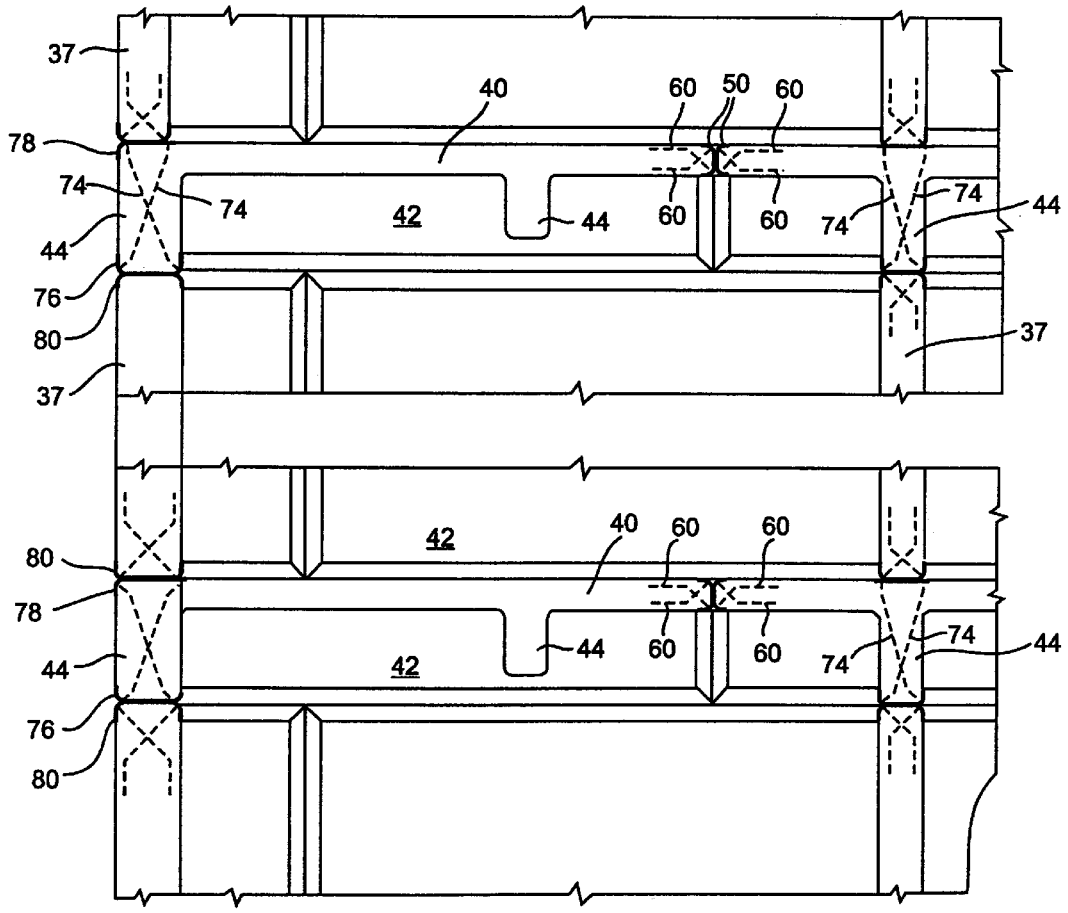
FIG. 4 is a cross-sectional view of the building structure along the section line 4—4 in FIG. 3 illustrating the connection between several panels.

FIG. 4 illustrates the way in which the secondary beams 44 are mounted on and connected to the vertical wall panels 37. As illustrated, the secondary beams 44 are provided with deformed bar anchors that criss-cross one another through the depth of the secondary beams 44. The deformed bar anchors 74 are similar to those described above in connection with the primary beams 42 of the horizontal panels. The bottom surface of the secondary beams 44 are provided with a break channel 76 that allows the secondary beams to be connected to the upper end of the underlying vertical wall panel 37. The upper surface of the secondary beams 44 are also provided with a break angle or plate 78 to permit connection to the lower end of the overlying vertical wall panel 37. Because the break angle or plate 78 is positioned on the upper surface of the secondary beams 44, only one end of the angle or plate is bent as shown in FIG. 4. Both ends of the vertical wall panels 37 are provided with break channels to permit connection with the overlying and underlying secondary beams 44.

The two deformed bar anchors 74 in the secondary beams, which are similar to the bar anchors 68, 70 shown in FIG. 9, are welded to the break channel 76 and the angle 78. One of the bar anchors 74 extends between one corner of the angle 78 and one corner of the break channel 76. The other bar anchor 74 extends between the unbent end of the angle 78 and the other corner of the break channel 76. The bar anchors 74 extend outwardly from the break channel section 76 and the angle 78 in the manner shown in FIG. 4 and are embedded in the concrete forming the secondary beam. By providing the break channel section 76 and the angle or plate 78 on the adjoining surfaces of the extended secondary beams and the adjacent vertical wall panels, it is possible to field weld the floor slabs to the vertical wall panels. That is, a weld can be applied along the oppositely located and horizontally extending adjoining outer edges of the break channel section or angle on the extended secondary beam and a similar break channel section on the adjacent vertical wall panel.

FIG. 4 also shows the welded connection between the break channels 50 of the floor slab 40 of adjacent horizontal panels.

Figure 5:
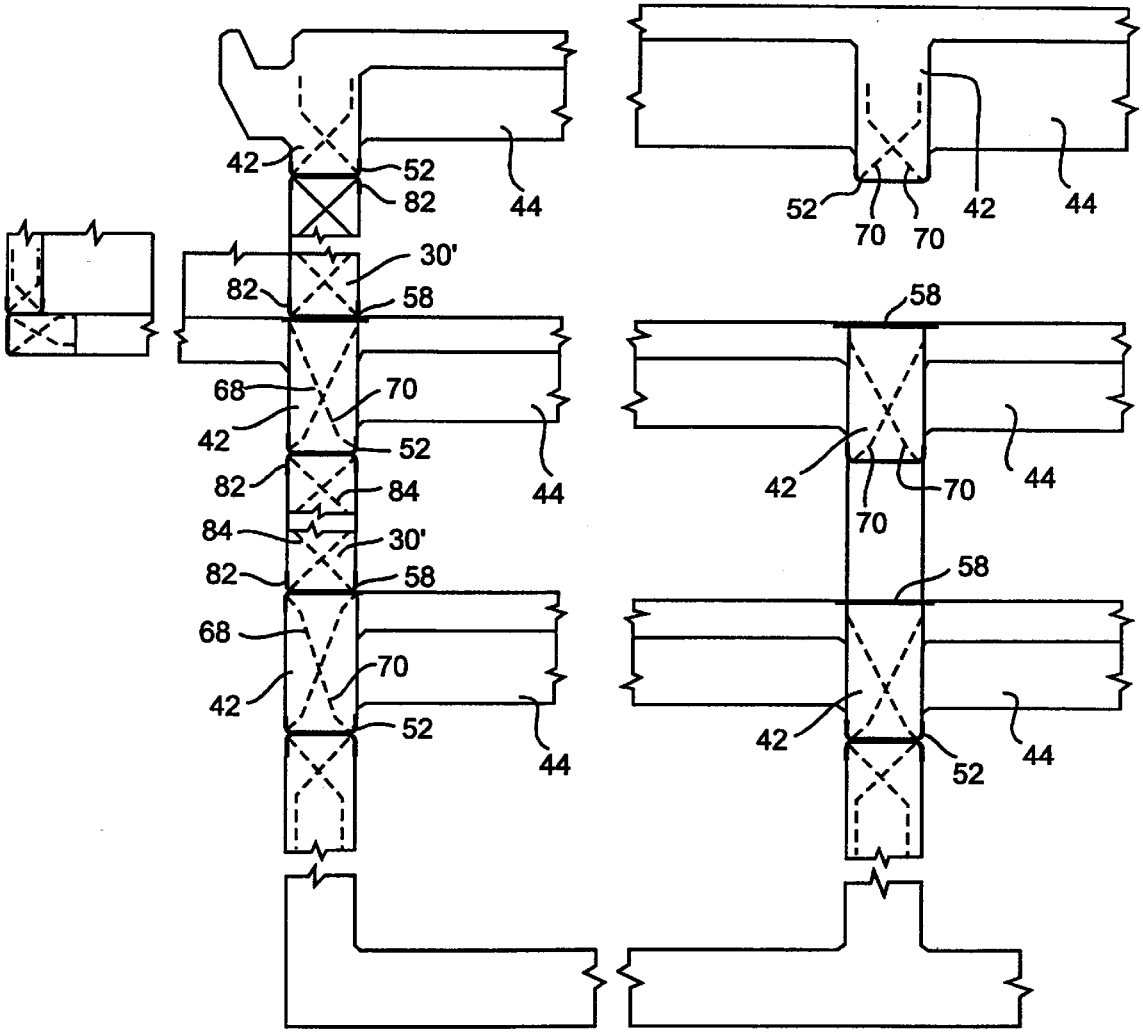
FIG. 5 is a cross-sectional view of the building structure along the section line 5—5 in FIG. 3 illustrating the connection between several panels.

FIG. 5 is an enlarged cross-section view of the left hand portion of the building structure shown in FIG. 1. As illustrated, the primary beams are situated on top of the vertical wall panels 30'. The upper and lower surfaces of the vertical wall panels 30' are provided with break channels 82. The break channel 82 on the upper surface of the vertical wall panels 30' are welded to the break channel 52 on the lower surface of the overlying primary beam 42. The break channel 82 on the lower end of the vertical wall panels 30' is welded to the plate 58 that is provided on the upper surface of the primary beam. The weld is applied along the oppositely located and horizontally extending adjoining edges of the break channel sections 82, 52. As also illustrated, the vertical wall panels can be provided with deformed bar anchors 84 that are welded to the interior corners of the break channel 82 in a manner similar to that described in connection with the primary beam shown in FIG. 9.

Figure 8:
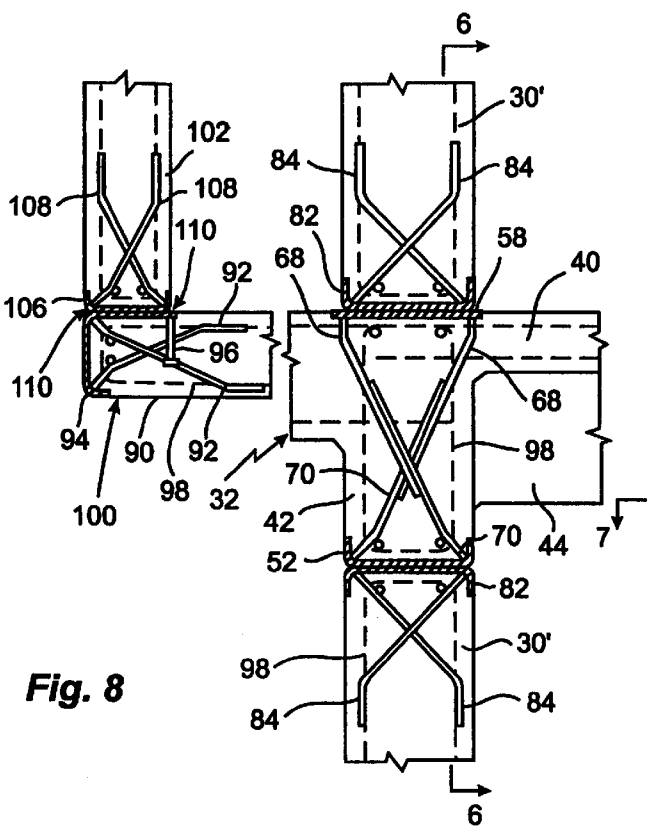
FIG. 8 is a vertical cross-sectional view of the portion of the floor of the building structure shown in FIG. 6 taken along the section line 8—8.

FIG. 8 illustrates an end portion of a horizontal panel connected to the overlying and underlying vertical walls 30'.

As noted earlier, the upper plate 58 on the upper surface of the primary beam 42 is welded to the break channel extending along the lower end of the overlying vertical wall panel 30'. Similarly, the break channel 52 extending along the lower edge of the primary beam 42 is welded to the break channel that extends along the upper edge of the underlying vertical wall panel 30', the weld being applied along the adjoining outer edges of the break channel sections. These welded steel connections join the upper and lower walls to produce the structural continuity between the vertical wall panels and the horizontal floor panel. The anchoring of the plate 58 and the break channel 52 on a primary beam to the break channels 82 of the overlying and underlying vertical wall panels is arranged to provide in addition to embedment a diagonal strength feature for resisting the torsion transfer from the secondary beams. This torsional reinforcement can be particularly important where large openings occur in the vertical wall panels above and below the primary beam. The deformed bar anchors 68, 70 provide reinforcement as well as connection between the plate 58 and the break channel 52 for the primary beam. Shear transfer longitudinally allows the plate 58 and the channel 52 to act with the concrete in a composite manner. The deformed bar anchors 84 in the upper and lower vertical wall panels 30' also provide reinforcement to mobilize the channels 84 so that they act in a composite manner with the concrete wall panels. The welding of the plate 58 to the break channel 82 of the overlying vertical wall panel 30' effects the connection of the upper vertical wall panel to the floor panel. Likewise, the welding of the break channel 52 to the break channel 84 on the lower vertical wall panel complete the connection for the lower wall to the floor panel. These welds can be made continuous for locations where a complete seal is required to the exterior. On the other hand, such welds can be made intermittent where load transfer allows some reduction in the weld length.

The left hand broken away portion of FIG. 8 illustrates the cantilevered portion that can extend from the primary beam. In the illustrated embodiment of the invention, this cantilevered portion represents a balcony 100. This balcony is also illustrated in FIG. 1. The cantilevered portion 100 includes a horizontally extending portion 90 and a vertically extending portion 102. The horizontally extending portion 90 defines the floor of the balcony while the vertically extending portion 102 constitutes a parapet wall.

To provide the necessary connection between the parapet wall 102 and the horizontal portion 90 of the cantilevered portion, metal or steel break sections are provided at the facing interfaces of the parapet wall 102 and the horizontal portion 90. The end surface of the horizontal portion 90 is provided with a break channel 94 while the parapet wall 102 is provided at its end face with a break channel 106. The break channel 94 includes legs of unequal length as can be seen from FIG. 8.

As in the case of the other panels described above, anchors are provided to secure the break channel section 94 in place relative to the concrete forming the horizontal portion of the cantilevered section 100. The horizontal portion 92 is provided with deformed bar anchors 92 that are welded to the interior corners of the break channel 94, and a headed anchor or stud 96 that is welded to the unbent end of the break channel 94. The deformed bar anchors 92, which are embedded in the concrete, extend from the interior corners of the break channel section 94 and are bent in the manner shown in FIG. 8.

The vertical portion 102 of the cantilevered section 100 is also provided with deformed bar anchors 108 that are embedded in the concrete forming the vertical portion 102 to firmly secure and anchor the break channel section 106 in place. The deformed bar anchors are welded to the interior corners of the break channel section 106. The deformed bar anchors 108 extend from the interior corners of the break channel section 106 and are bent in the manner shown in FIG. 8.

To form the cantilevered balcony 100, the vertical portion 102 and the horizontal portion 90 are connected to one another by providing a weld along the oppositely positioned and horizontally extending outer mating edges 110 of the two break channel sections 94, 106.

Figure 6:
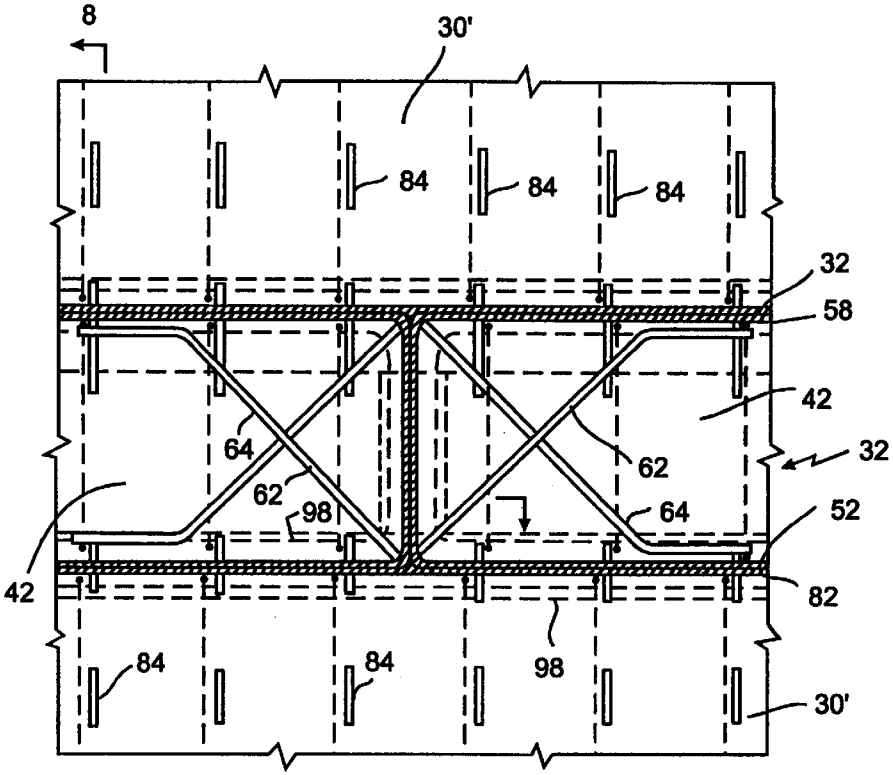
FIG. 6 is a plan or vertical sectional view of a portion of a floor of the building structure shown in FIGS. 1 and 2 illustrating the connection between two building panels.
Figure 7:
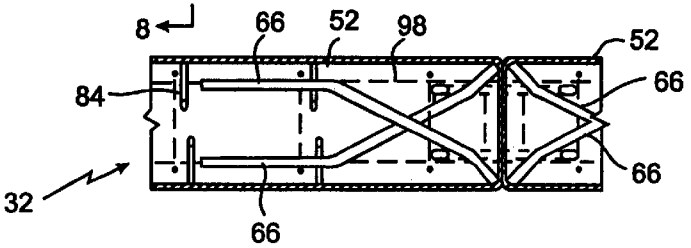
FIG. 7 is a cross-sectional plan view of the portion of the floor of the building structure shown in FIG. 6 taken along the section line 7—7.

FIG. 6 illustrates the way in which the primary beams of two adjacent horizontal panels are connected to one another as well as to the overlying and underlying vertical wall panels 30'. FIG. 7 is a cross-sectional view of the connection shown in FIG. 6 taken along the section line 7—7. In FIG. 7, the deformed bar anchors 66 are illustrated in a slightly different configuration than that shown in FIG. 9. In FIG. 7, the deformed bar anchors 66 are depicted as extending into the concrete slab from the interior corner of the beam break channel 52 at an initial angle of 45° followed by a bend in the deformed anchor 66 to an angle of about 30° and a subsequent further bend where the deformed bar anchor 66 extends generally parallel to the flanges of the beam break channel 52. Although both configurations can be employed, the configuration shown in FIG. 7 is preferred as it is desirable to have the bar anchors extend in a direction that more closely parallels the beam break channel 52.

As can be seen from FIGS. 6–8, embedded within the concrete forming the vertical wall panels 30' and the horizontal floor panels 32 is typical reinforcing rebars or other types of standard reinforcement 98. This reinforcement, which can be the same as that conventionally used to reinforce concrete structures, is shown in dotted line configuration in FIGS. 6–8.

By virtue of the present invention, it is possible to utilize prefabricated panels in the construction of building structures. Prefabricated panel construction offers a variety of advantages such as being the simplest and cheapest method of forming a high quality concrete panel into a precisely fabricated steel frame. Also it lends itself to the layout and embedment of a number of items such as the rebar itself and structural steel fixtures. In addition, it is possible to fabricate the panels such that they include pipes, conduits and even small plenums for carrying the electrical and mechanical services required throughout the building structure. The connections can be designed to permit passage of these various conduits from panel to panel. When a tee beam slab configuration is adopted, the space between the outstanding legs and the provision of holes through the webs can be used to accommodate these services. Also, a false soffit could be provided as a ceiling which would also incorporate lighting, ventilation and other fixtures. Vertical chimneys can be readily incorporated into the panel construction allowing the major services from the basement or roof to be routed vertically to all floors for further horizontal distribution.

The present invention also is quite advantageous in that the steel break channels and plates which are used to connect adjacent panels can serve as the formwork for the concrete and can provide the gauge control for layout work and other templates needed to ensure precise fabrication standards. Protection and strength for initial handling after concrete placing and during the curing phases is also provided. Further, and possibly more importantly, the connection elements that permit connection of adjacent panels protect against damage during handling, transportation and final erection. Exterior finishes can be readily introduced to the type of construction envisioned by the present invention, including the use of molds to create artificial stone, brick or other finishes where desired. Once again the connection mechanism allows the handling and storage of the panels by the introduction of lifting devices which will facilitate such handling and minimize panel damage. Temporary erection devices are readily incorporated into the erection plan and procedure where proper equipment selection is made to ensure safe erection allowing panels to be held securely until the final welding completing the connections can be carried out.

It is possible through utilization of panels constructed in accordance with the present invention to manufacture panels up to 60 feet in length and 14 feet in width. Where transportation logistics permit, greater widths and lengths can be considered. This would also be combined with availability of cranage and load carrying vehicles to handle units generally held at less than 25 tons in weight.

As described above, the basic connection concept for connecting together adjacent panels in the building structure involves the use of steel break channel sections rather than rolled steel sections. This provides greater flexibility in producing the channel sections needed where unequal legs are often required. The use of steel break channel sections is also advantageous in that it provides weld preparation surfaces which are conducive to penetration welding and forming a flush finish when panels are brought together for connection. Further, break channel sections are generally less expensive than rolled sections and can be formed cold with consistent quality up to ⅜ inch plate thickness.

The present invention allows the use of steel studs or rebar dowels using a Nelson type stud connector with ferrules for effecting a weld to the steel break sections, plates and angles described above. Although FIG. 9 shows a single pair of deformed bar anchors 60 welded to the break channel 50 and extending into the concrete floor slab, it is to be understood that such deformed bar anchors would be provided at regular spaced apart intervals, for example 12 inch center-to-center spacing. Similarly, the arrangement of deformed bar anchors 68, 70 that is welded to the break channel 52 and the plate 58 for the primary beam 42 are preferably disposed at regular spaced apart intervals along the primary beam, for example 12 inch center-to-center spacing. Specific channel dimensions, spacing, bar sizes, weld design and plate thickness will be based on actual design loadings and the corresponding moment and shear intensities calculated. The reinforcing steel mats are preferably prefabricated and welded together in order to provide maximum stress transfer from the steel connection through the concrete slabs to the opposite connection.

The connection configuration in accordance with the present invention fully meets the moment transfer associated with typical building structures. More importantly, the connection arrangement exhibits a gradual failure mode preferred for seismic resistant structures. This highly advantageous aspect of the present invention is made possible by the bent and welded deformed anchor bars which are able to straighten and exhibit non-elastic yielding prior to tensile failure.

With respect to the connection between the horizontal panels and the vertical wall panels, the break channel along the free edge of the vertical wall panels provides a constraining confinement to the boundary concrete which in turn allows a greater area of shearing surfaces to be mobilized. Shear transfer through the headed studs or deformed bar anchors which are arranged to start at or about 45 degrees from the interior angle mobilizes the shear transfer in the concrete in such a way that the confining of the boundary concrete within the steel angles maximizes the shear cone resistance. Moment transfer at right angles to the longitudinal direction is carried through the deformed bar anchors that are bent to cross through the slab or beam at between 45 degrees and 30 degrees. These deformed bar anchors intercept zones of diagonal tension in the concrete to thereby provide shear reinforcement and also help to resist moments caused by lateral forces acting in either direction from wind or seismic forces. This bending resistance in two directions also provides the moment resisting vertical frames that combine with the bearing loads in the walls which are also acting as shear panels to distribute the loads transferred from the roof and floors to the building foundation. A significant advantage of the two angles forming the break channel is its ability to mobilize both shear transfer and moment transfer between adjacent panels through the interconnecting welds.

The transfer of shear and moment across and through the completed connection requires two continuous welds between the two break channels. This allows them to act together structurally. In this configuration, shear transfer is transmitted along and across the weld line. Moment transfer from the deformed bar anchors is transmitted to these weld lines across and through the angle sections formed by each side of the steel break channels. Point loads from these anchors are distributed uniformly along the angles formed by the channels. This thus takes advantage of the stiffness offered by the section modulus of the angles and avoids weld tearing associated with stress concentrations. In the case of the planar unstiffened plates 58 that do not possess angled sides like the U-shaped break channels, the weld connection to the abutting break channel provides structural integration with the upstanding leg and again provides the necessary section modulus from the angle to distribute point loads. Alignment of the deformed bar weld with the corner of the angle and the longitudinal weld are located to minimize panel point eccentricities. This is important from the standpoint of avoiding buckling or tearing stresses introduced by moments from eccentricities created by any misalignments within the working node. The 45 degree setting or orientation of the deformed bar anchors splits the interior angle of the channel to suit the ceramic ferrule enclosing the weld material and facilitates alignment accuracy. The deformed bar anchors possess a geometry that is designed to suit the welding or ferrule placement. With the U-shaped break channel sections, this typically means orienting the deformed bar anchors at 45° so that the deformed bar anchors extend at such an angle from the corners of the break channel sections for a distance of about three inches. Beyond this point, the bar angle can be bent at an appropriate angle selected to best suit the stress transfer or to suit the geometry of matching the position of the bars as in the case of the bar anchors 68, 70 in FIG. 8.

The curvature created by the exterior rounded surface of the break channel section provides an excellent weld preparation and alignment with virtually no cutting or grinding required prior to welding. This advantageously permits a flush exterior finish to be imparted to the final product, and the shown arrangement permits great flexibility in allowing the weld strength to be varied to suit the actual load transfer calculated. This same flexibility can be introduced to the anchor bar diameters and to the spacing of these bars along the break channel, where shear and moment forces vary.

Also where shear transfer has to be increased, shear studs can be interspersed with the anchor bars. The thickness of the plate forming the break channels can be varied significantly to accommodate variations in loadings imposed on different panels at critical points. A change in the wall width can also be carried out using this floor transition section where the upper wall is lesser in width than the lower wall and the anchor bars from the flat plate are aligned to meet the break channel from the upper reduced wall panel width. Break channels and plates forming the above connections are reduced to 50% of the full width with the removal of the middle half of the plate along the length of the connection. This provides openings to facilitate concrete placement and embedment continuity. It also reduces thermal transfer from the exterior side of an outside wall to the interior face. Further, it economizes on the amount of structural steel used in the panels. Thermal bridging through the channel connection is mainly eliminated by the use of facing blocks fixed to the exterior face. These blocks are also employed for architectural effect.

The panels according to the present invention also present advantages from a manufacturing standpoint. Manufacturing of the various panels is preferably carried out in a long covered factory bay which is provided with bridge cranes for the different fabrication phases. A typical layout for the assembly line operation required for the mass production of the panels includes a central bay which is provided with rails running longitudinally through the bay supporting a number of movable work platforms which receive the panel components. These platforms are composed of steel frame members with a stiff smooth steel surface equipped with a pattern of dogging and clamping devices to firmly secure and restrain the panel framing. Formwork for beams are arranged for upstanding stems, although provisions are also incorporated for a downwards stem. A centrally hinged configuration allows roof slabs to be formed with an adequate runoff slope which is built into the panel surface when initially poured.

Adequate space around the panel frame should be provided to permit free and secure access for craftsmen working on the panels. As the panels progress through the central bay they can be serviced from an adjacent bay where materials and components are preformed and assembled into sub components to facilitate and expedite panel work on the assembly line. Spacing and sizing of the adjacent assembly shops are arranged to optimize the rate of fabrication, and using normal time and motion methods provide effective manpower and equipment disposition. Cost comparisons between normal concreting and formwork practices provides a very positive cost advantage for the slab construction in the factory versus suspended floors and walls constructed in the field where the concrete is poured in place.

The different fabrication shops cover, in addition to the steel frame and rebar setting, the teams to install mechanical and electrical embedments and templates for doors and windows. Also included are the features to provide various exterior finishes desired on the panels which are incorporated just prior to concreting. Concreting equipment is arranged to permit the placement of two or more types of concrete in the same panel during the time period that will keep the concrete sufficiently plastic to combine the concrete in a composite manner. Work platforms with the recently placed concrete panels can be moved into the rapid-cure portion of the main bay. Here, in a steam curing environment, concrete strengths can be quickly achieved in about 16 hours to allow the panels to be tilted for stacking in a vertical position. At this point the movable work platforms are released, cleaned and transported back to the beginning of the assembly line by the traveling cranes. The panels now stacked in a vertical space efficient manner continue curing until adequate strength is reached for transportation and erection. These panels will have adequate protection installed to prevent damage to the finished surfaces during transportation and erection handling.

Transportation of these panels can be by rail, road or water using specially designed cradles for vertical stacking. These cradles can be developed to suit the transportation mode selected and provide the required protection against damage. Embedded devices are provided in all of these factory panels to match the lifting devices, hooks and spreader beams used for handling. These same lifting devices and handling equipment are designed for erection of the panels. Temporary strutting is also provided to hold and align panels as they are assembled using the same embedments. This strutting is designed to permit precise adjustments of the panel assembly to complete and hold the alignment during the final welding.

Structurally, the building structure relies on the two exterior walls and a single interior wall to act as longitudinal shear panels. End walls on each end of the building and other transverse walls act as shear walls which when combined structurally with the longitudinal walls provide a system of plates providing 360 degrees of resistance to lateral forces.

The rigid moment frame in accordance with the present invention provides the primary resistance to the vertical dead and live loadings with the beam and slab floors and roof distributing these reactions to the vertical wall panels. The rigid moment frame is best seen with reference to FIG. 1 where three vertical panels or members 30', 30", 30' combine with five horizontal panels or members 35, 32, 32, 32, 33 thru fifteen rigid connections. The way in which the various panels are connected together through welding of the break channels and plates significantly reduces design deflections and maximum moments with corresponding economies of materials. Also additional resistance is offered by the rigid frame which supplements the vertical shear panels that provide most of the resistance to lateral loads. Where the vertical panels are significantly broken by door openings, windows or entry ways, structural continuity is provided by the primary beams in the horizontal floor or roof slabs. The reinforcement within these beams is arranged through the connections to span the openings and provide torsional support to resist the end moments of the secondary beams. Where openings are not present, this torsional support is provided by the lower and upper wall panels, integrated structurally with the primary beam through the steel connections.

The vertical wall panels or shear plates provide lateral resistance against horizontal forces from all directions. These vertical plates are structurally integrated with the floor and roof plates and form a three dimensional cellular structure that permits resistance to both lateral and vertical seismic forces. The vertical plates receive lateral support at each story from the floors or roof slabs resisting any tendency of the plates to buckle. In the case of the horizontal panels, they are integrated at each panel through the slab connection and further joined by the primary beam connection.

Each of the vertical and horizontal plates are formed by a number of individual panels factory crafted and delivered essentially finished. The building structure depicted in FIGS. 1–9 act as a three-dimensional cellular structure. The plates forming the cellular structure are in the horizontal and vertical planes and are combined to behave as a single structure. In the vertical plane, these plates are best seen in FIGS. 1 and 2. As seen in FIG. 2, the horizontal plates are readily identified along the primary beam part of the intermediate wall 30" where the floor panels are separated from one another such that each panel has two secondary beams integrated with the primary beams and floor slab. A total of nine such panels forms the full horizontal plate.

The vertical plate best seen in FIG. 1 is made up of four wall panels 37 and portions of the floor slab secondary beams 44, and the roof panel secondary beam 44. This vertical plate includes openings 34 that significantly affect the vertical plate's behavior as a shear wall. In FIG. 2, the illustrated vertical plate is the intermediate wall 30". The openings 38 once again significantly affect the plate's behavior. The openings 38 in the lowermost level (e.g., basement),which can serve as entrance openings for automobiles, are much larger than on the other levels. The primary beams also form an important part of the vertical plates by connecting the wall panels 30" to each other through the primary beam connection in FIG. 8.

These panels can be equipped with conduits, raceways, pipework and plenums embedded in the panel concrete so as to be ready for field erection. Each panel is confined within the proprietary connection frame using fabrication tolerance standards normal for structural steel work in order to assure accurate fit-up prior to final welding of the connections. To minimize weld distortion, it may be necessary to clamp and thereby securely lock the panels, coupled with following good welding procedures. By precasting the concrete panels, shrinkage stresses from the concrete curing are essentially negated, limiting later movements strictly to temperature variations.

Exterior walls form plates with a large number of significant openings provided for doors and windows. The connections are designed to allow shear loading to be transferred horizontally through the welded studs projecting from the interior angles of the break channels that are welded together between panels. Completed plates behave as a vierendeel girder created by the panels having openings and rigid joints with spandrel types beams bridging these openings. Lateral support for the walls is provided at each floor and roof level where various connection details permit loading and stress transfer. In the building structure shown in FIGS. 1 and 2, the relative stiffness provided by the central load bearing wall with a smaller number of openings is transferred through the floor plates to the exterior walls to resist longitudinal lateral forces. This behavior greatly reduces the displacement movement horizontally of the more flexible exterior walls under seismic loading. Avoidance of flexure or sway movements is inherent in the present invention where stiffness is obtained by the structurally strong panel configuration. For lateral loadings, the moment frame is not called upon to provide the lateral stability in the building which is taken by the stiffer vertical and horizontal shear slabs or plates.

The precast connection provided by the steel break channels and steel plates is intended to provide a similar level of structural continuity between wall and floor panel plates that form the module to that which can be achieved with reinforced concrete connections when the concrete is poured in place. Fully rigid connections are created when conventional poured in place concrete practice is followed. This in turn provides optimum material use by allowing end fixity to reduce both moments and corresponding deflections. Node fixity can also provide some resistance against lateral loadings from wind or seismic loadings by mobilizing the rigid frame reaction. The connection between panels in accordance with the present invention allows the various individual panels to behave structurally in a similar manner to that of the poured in place modules described above. In addition, these panels when combined form vertical and horizontal diaphragms or plates with high resistance against lateral forces, as they behave as shear walls in a cellular structure. By providing end fixity and node fixity, the unsupported spans are stiffened at the ends carrying the end moments. This has the affect of reducing mid-span moments by about 50%, thus reducing the beam and slab dimensions accordingly and making possible a reduction in the amount of materials utilized.

The horizontal floor panels of slab and beam design, in addition to supporting vertical loads, provide the means to distribute the lateral forces to the vertical diaphragms. Walls and columns acting as the resisting vertical elements from floor and roof also in turn provide lateral stiffness as they behave as shear walls. The vertical shear walls are interconnected to the horizontal floor panels to allow lateral forces to be transferred to the foundations. The relative movements of these vertical shear walls which possess different numbers and sizes of openings are restrained by the floors acting as stiff horizontal shear panels. This in effect minimizes differential movements among walls forming each story and limits any tendency to buckle under seismic loadings by reducing movements in any part of the building that could behave as a soft story.

Connection details forming the primary beams provide the key integration between the floor and wall panels. The primary beam forms an integral part of the vertical walls and also supports the reaction from the secondary beams forming the floor and roof system. Secondary and primary beams are cast in the factory in an integral manner. However, the primary beam and slab connections are field welded in their final position on the building.

The vertical wall panels can be cast in the factory with openings formed and stub walls added for vertical wall connections. These stub walls allow certain corners on the vertical sections to be factory cast, thereby providing maximum strength in these critical areas in addition to stiffening the panel for handling. Vertical connections between walls are field welded and located in areas of low stress. Wall panels are normally single story in height and integrated into multi-story diaphragms by connections to the primary beams again using field welds. The key to the structural adequacy of the building system occurs at this location where the fixity created at this node controls the building behavior as a rigid frame.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A building panel for use in constructing a building structure comprising:

a generally planar concrete slab;

a plurality of primary beams made of concrete, the primary beams being formed with the concrete slab and extending from a lower surface of the slab;

a plurality of secondary beams made of concrete, the secondary beams being formed with the concrete slab and extending from the lower surface of the slab, the secondary beams extending transverse to the primary beams;

a generally U-shaped channel extending along the length of each primary beam at a lower surface of the primary beam;

a steel plate disposed along an upper surface of the concrete slab;

a plurality of first bar anchors welded to each channel that extends along the length of each primary beam, each first bar anchor extending through the concrete forming the primary beam and extending into the planar concrete slab;

a plurality of second bar anchors welded to the steel plate and extending through the planar concrete slab and into the primary beam.

2. The building panel according to claim 1, wherein the primary beams possess a depth that is greater than the secondary beams.

3. The building panel according to claim 1, wherein each bar anchor is welded to an interior corner of the respective channel and extends diagonally through the concrete forming the primary beam.

4. The building panel according to claim 3, wherein the bar anchors include first and second portions that are angularly oriented relative to one another.

5. The building panel according to claim 1, including a U-shaped metal channel extending along the length of each secondary beam at a lower surface of each secondary beam, and a plurality of bar anchors welded to the U-shaped metal channel extending along the length of each secondary beam, the bar anchors that are welded to the U-shaped metal channel extending along the length of each secondary beam extending through the secondary beam and into the planar concrete slab.

6. A building panel for use in constructing a building structure comprising:

a generally planar concrete slab, said concrete slab having an edge face;

a plurality of primary beams made of concrete and possessing a depth, the primary beams being formed with the concrete slab and extending from a lower surface of the concrete slab;

a metal U-shaped first channel section separate from said concrete slab and positioned on said edge face of the concrete slab so that the metal member is exposed for serving as a welding surface, said metal U-shaped first channel section extending along the edge face of the concrete slab and along portions of side surfaces of said concrete slab which intersect the edge face;

a plurality of first bar anchors welded to said metal U-shaped first channel section and embedded in said concrete slab, each first bar anchor being welded to a surface of said metal U-shaped first channel section which faces said concrete slab to fix said metal U-shaped first channel section in place relative to said concrete slab, said metal U-shaped first channel section including interior corners, said first bar anchors being welded to the interior corners of said metal U-shaped first channel section;

a generally U-shaped second channel extending along the length of each primary beam at a lower surface of the primary beam;

a plurality of second bar anchors welded to the U-shaped second channel and extending through the depth of the primary beam and into the concrete slab.

7. The building panel according to claim 6, wherein the bar anchors include first and second portions that are angularly oriented relative to one another.

8. The building panel according to claim 6, wherein said concrete slab includes a planar concrete floor panel, and including a plurality of spaced apart secondary beams extending from the concrete floor panel.

9. The building panel according to claim 8, wherein said concrete slab possesses an upper surface, and including a metal plate extending along the length of the upper surface of the concrete slab, and including a plurality of spaced apart third bar anchors connected to the metal plate extending along the length of the upper surface of the concrete slab, said third bar anchors extending through the concrete slab and into the concrete forming the primary beams.

10. A building structure comprising:

a generally planar first concrete floor panel, said first concrete floor panel having an edge face, a first metal member positioned at the edge face of the first concrete floor panel, and a plurality of first bar anchors welded to the first metal member and embedded in the first concrete floor panel to secure the first metal member in place relative to the first concrete floor panel;

a generally planar second concrete floor panel, said second concrete floor panel having an edge face, a second metal member positioned at the edge face of the second concrete floor panel, and a plurality of second bar anchors welded to the second metal member and embedded in the second concrete floor panel to secure the second metal member inplace relative to the second concrete floor panel;

said first metal member being welded to the second metal member so that the first and second concrete floor panels are connected to one another;

a concrete beam extending from the first concrete floor panel, the concrete beam having a lower surface;

a third metal member extending along the length of the concrete beam;

a plurality of third bar anchors welded to the third metal member and embedded in the concrete beam;

a generally planar concrete wall panel having an end surface;

a fourth metal member extending along the length of the end surface of the concrete wall panel, said third metal member being welded to the fourth metal member.

11. The building panel according to claim 10, wherein said concrete beam is a secondary concrete beam, and including a plurality of spaced apart concrete primary beams extending from the first concrete floor panel, said primary and secondary beams extending transverse to one another.

12. A building structure comprising:

a vertically oriented generally planar first concrete wall panel having a first concrete stub wall extending generally perpendicular to the planar first wall panel, said first stub wall having a vertically oriented end face, a first metal channel positioned at said end face of the first stub wall, and a plurality of first bar anchors welded to the first metal channel and embedded in the first concrete stub wall;

a vertically oriented generally planar second concrete wall panel having a vertically oriented end surface at which is positioned a second metal channel, and a plurality of second bar anchors welded to the second metal channel and embedded in the second concrete wall panel, said second concrete wall panel having a second stub wall extending generally perpendicular to the planar second wall panel, said second stub wall having a vertically oriented end face, a third metal channel positioned at said end face of the second stub wall, and a plurality of third bar anchors welded to the third metal channel and embedded in the second concrete stub wall;

said first metal channel being welded to the second metal channel to secure the first and second wall panels to one another.

13. The building structure according to claim 12, including a vertically oriented generally planar third concrete wall panel having a vertically oriented end surface at which is positioned a fourth metal channel, and a plurality of fourth bar anchors welded to the fourth metal channel and embedded in the third concrete wall panel, said third metal channel being welded to the fourth metal channel.

14. The building structure according to claim 12, including a horizontally oriented concrete floor slab overlying the first concrete wall panel, the concrete floor slab including a metal channel extending along a lower portion of the concrete floor slab, and a plurality of bar anchors welded to the metal channel extending along the lower portion of the concrete floor slab and embedded in the concrete floor slab, said first concrete wall panel including a metal channel extending along an upper edge face of the first concrete wall panel, and a plurality of bar anchors welded to the metal channel extending along the upper edge face of the first concrete wall panel, the metal channel extending along the lower portion of the concrete floor slab being welded to the metal channel extending along the upper edge face of the first concrete wall panel.

* * * * *